US008540360B2

(12) United States Patent
Nitta et al.

(10) Patent No.: US 8,540,360 B2
(45) Date of Patent: Sep. 24, 2013

(54) PRINTING APPARATUS, PRINTING METHOD, AND SHEET PROCESSING METHOD

(75) Inventors: Tetsuhiro Nitta, Yokohama (JP); Yasuhiko Ikeda, Sagamihara (JP); Masahito Yoshida, Shiki (JP); Kota Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 428 days.

(21) Appl. No.: 12/949,682

(22) Filed: Nov. 18, 2010

(65) Prior Publication Data

US 2011/0211030 A1 Sep. 1, 2011

(30) Foreign Application Priority Data

Feb. 26, 2010 (JP) ..... 2010-042349

(51) Int. Cl.
*B41J 2/01* (2006.01)

(52) U.S. Cl.
USPC ..... 347/102; 347/104

(58) Field of Classification Search
USPC ..... 347/104, 101, 16, 102
See application file for complete search history.

(56) References Cited

U.S. PATENT DOCUMENTS

| | | | | |
|---|---|---|---|---|
| 4,453,841 | A * | 6/1984 | Bobick et al. | 347/16 |
| 5,987,300 | A | 11/1999 | Mori | |
| 6,536,863 | B1 * | 3/2003 | Beauchamp et al. | 347/17 |
| 6,575,455 | B2 * | 6/2003 | Thøgersen et al. | 271/186 |
| 6,624,876 | B2 * | 9/2003 | Fukuda et al. | 355/29 |
| 6,718,146 | B2 * | 4/2004 | Nakamori | 399/22 |
| 6,719,469 | B2 * | 4/2004 | Yasui et al. | 400/603 |
| 6,729,780 | B2 * | 5/2004 | Sampson et al. | 400/74 |
| 6,850,261 | B2 * | 2/2005 | Taki et al. | 347/156 |
| 7,018,120 | B2 * | 3/2006 | Takagi | 400/582 |
| 7,236,736 | B2 * | 6/2007 | Konagaya | 399/401 |
| 7,458,674 | B2 | 12/2008 | Itoh | |
| 2002/0038591 | A1 * | 4/2002 | Fukushima et al. | 83/408 |
| 2003/0063175 | A1 * | 4/2003 | Nishikawa | 347/104 |
| 2003/0151652 | A1 * | 8/2003 | Shima et al. | 347/102 |
| 2003/0156176 | A1 * | 8/2003 | Miyamoto et al. | 347/102 |
| 2003/0189628 | A1 * | 10/2003 | Kaga et al. | 347/102 |
| 2004/0046312 | A1 | 3/2004 | Thogersen | |

(Continued)

FOREIGN PATENT DOCUMENTS

| | | | |
|---|---|---|---|
| CN | 1122751 | A | 5/1996 |
| JP | 61-028754 | U | 2/1986 |

(Continued)

*Primary Examiner* — Stephen Meier
*Assistant Examiner* — Leonard S Liang
(74) *Attorney, Agent, or Firm* — Canon USA, Inc., IP Division

(57) ABSTRACT

An apparatus for performing duplex printing having a sheet feeding unit, a printing unit, a cutter unit, a drying unit, and a reverse unit. In the duplex printing, the printing unit prints a plurality of images on a first surface of a sheet fed from the sheet feeding unit. The sheet is a continuous sheet. The sheet printed on the first surface passes through the drying unit and is led to the reverse unit. The reverse unit feeds the reversed sheet to the printing unit and the printing unit prints a plurality of images on a second surface that is a back of the first surface of the sheet fed from the reverse unit. The cutter unit cuts the sheet printed on the second surface into a plurality of cut sheets each having the image printed thereon. The cut sheets pass through the drying unit and are ejected.

21 Claims, 6 Drawing Sheets

(56) References Cited

U.S. PATENT DOCUMENTS

| | | | | |
|---|---|---|---|---|
| 2004/0179878 | A1* | 9/2004 | Eskey | 399/401 |
| 2005/0088504 | A1* | 4/2005 | Kudoh et al. | 347/104 |
| 2007/0222144 | A1* | 9/2007 | Inui et al. | 271/291 |
| 2008/0159800 | A1* | 7/2008 | Wada | 400/621 |
| 2009/0033026 | A1* | 2/2009 | Fuchi | 271/227 |
| 2009/0141110 | A1* | 6/2009 | Gervasi et al. | 347/100 |
| 2010/0238251 | A1* | 9/2010 | Tsuzawa | 347/104 |

FOREIGN PATENT DOCUMENTS

| | | | | |
|---|---|---|---|---|
| JP | 11-249346 | A | | 9/1999 |
| JP | 2002-020043 | A | | 1/2002 |
| JP | 2002-361850 | A | | 12/2002 |
| JP | 2003-039750 | A | | 2/2003 |
| JP | 03470696 | B2 | | 11/2003 |
| JP | 2004-268572 | A | | 9/2004 |
| JP | 2005-193546 | A | | 7/2005 |
| JP | 2008030899 | A | * | 2/2008 |
| JP | 2008-126530 | A | | 6/2008 |
| JP | 2008-296472 | A | | 12/2008 |
| JP | 2009-060668 | A | | 3/2009 |
| JP | 2009-255564 | A | | 11/2009 |
| WO | 2009/087778 | A1 | | 7/2009 |

* cited by examiner

PRINTING APPARATUS, PRINTING METHOD, AND SHEET PROCESSING METHOD

BACKGROUND OF THE INVENTION

1. Field of the Invention

The present invention relates to an apparatus and a method for performing printing on a sheet.

2. Description of the Related Art

Duplex printing is a printing apparatus feature that allows the automatic printing of a sheet on both sides. Japanese Patent Laid-Open No. 2008-126530 describes a printing apparatus that performs duplex printing on both sides of a long continuous roll sheet using an inkjet printing method.

When performing duplex printing, the apparatus described in Japanese Patent Laid-Open No. 2008-126530 performs printing on the front surface of a sheet and winds the sheet onto a winding roller, reverses the front and back surfaces of the sheet, and performs printing on the back surface of the sheet. If the ink is not sufficiently dried when the sheet is rolled, the ink undesirably is transferred to another portion of the rolled sheet. In addition, in the apparatus described in Japanese Patent Laid-Open No. 2008-126530, the printed sheet is cut page by page after the duplex printing is performed, and the cut sheet is output onto a tray. If the next cut sheet is output onto the sheet before the printed sheet is sufficiently dried, the ink undesirably is transferred to the sheet when the next sheet is topped on the sheet, or the drying of the sheet is further delayed. Accordingly, for the apparatus described in Japanese Patent Laid-Open No. 2008-126530, a sufficient period of time for naturally drying the ink is needed during a printing operation.

In a high volume printing market, such as print labs, it is required to increase the print throughput (the number of prints per unit time). One of the factors that prevents the print throughput from increasing is a long ink drying time after a print operation is performed. For the apparatus described in Japanese Patent Laid-Open No. 2008-126530, a sufficient period of time for naturally drying the ink is needed. This period of time prevents the print throughput from increasing. In particular, in a duplex printing operation, a large amount of ink is supplied to the front and back surfaces of the sheet. Therefore, if a natural drying process is used, it is difficult to increase the print throughput.

SUMMARY OF THE INVENTION

Accordingly, the present invention provides a duplex printing apparatus having a high total print throughput by reducing an ink drying time. More specifically, the present invention provides a duplex printing apparatus including a plurality of units including a drying unit needed for high-speed duplex printing that are arranged in a rational manner. The present invention further provides a printing method and a sheet processing method for high-speed duplex printing.

According to an embodiment of the present invention, an apparatus for performing duplex printing includes a sheet feeding unit, a printing unit, a cutter unit, a drying unit, and a reverse unit. In the duplex printing, the printing unit prints a plurality of images on a first surface of a sheet fed from the sheet feeding unit. The sheet is a continuous sheet. The sheet printed on the first surface passes through the drying unit and is led to the reverse unit. The reverse unit feeds the reversed sheet to the printing unit and the printing unit prints a plurality of images on a second surface that is a back of the first surface of the sheet fed from the reverse unit. The cutter unit cuts the sheet printed on the second surface into a plurality of cut sheets each having the image printed thereon. The cut sheets pass through the drying unit and are ejected.

According to the present invention, in a duplex print mode, the ink drying time can be reduced and, therefore, a high-throughput printing apparatus and a high-throughput printing method can be realized.

Further features of the present invention will become apparent from the following description of exemplary embodiments with reference to the attached drawings.

DESCRIPTION OF THE EMBODIMENTS

A printing apparatus using an inkjet printing method according to an embodiment of the present invention is described below. A unit of printing is referred to as a "page" or a "unit image" and a long continuous sheet is longer than repeated units of printing in the conveying direction of the sheet. According to the present embodiment, a printing apparatus employs a long continuous sheet. The printing apparatus is a high-speed line printer that is operable in either one of a simplex print mode and a duplex print mode. The printing apparatus is suitable for a high-volume printing market, such as print labs. As used herein, even when a plurality of small images, characters, and blanks are present in an area of a unit of printing (a page), the small images, characters, and blanks are collectively referred to as a "unit image". That is, the term "unit image" refers to a unit of printing (a page) when a plurality of pages are sequentially printed on continuous sheet. Note that a unit image is also simply referred to as an "image". The length of a unit image varies in accordance with the image size to be printed. For example, the length of an L size photo in the conveying direction is 135 mm, and the length of an A4 size photo in the conveying direction is 297 mm.

The present invention is widely applicable to a printing apparatus that uses ink and requires an ink drying process, such as a printer, a multi function peripheral, a copier, a facsimile, or equipment used for manufacturing a variety of devices. In addition, the present invention is applicable to a printing apparatus that renders a latent image using, for example, a laser beam and performs printing using a liquid development method. Furthermore, in addition to print processing, the present invention is applicable to a sheet processing apparatus that performs a variety of processes (e.g., recording, processing, application, irradiation, reading, or inspection) on a continuous sheet that requires a drying process.

Figure 1:
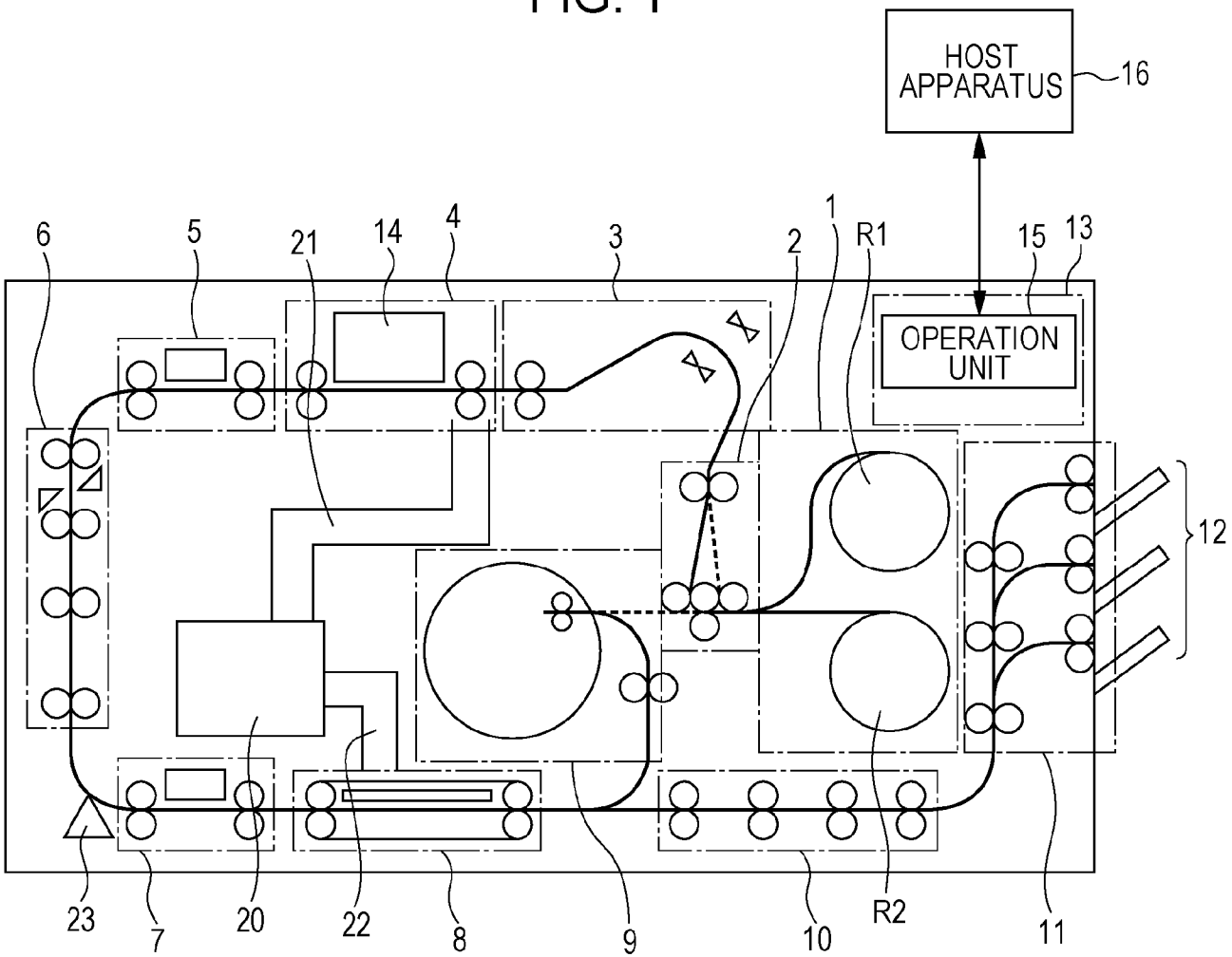
FIG. 1 is a schematic illustration of an exemplary internal configuration of a printing apparatus.

FIG. 1 is a cross-sectional view schematically illustrating the internal configuration of the printing apparatus. According to the present embodiment, the printing apparatus can perform duplex printing on the first surface of a rolled sheet, which is a front surface of the first sheet, and the second surface of the sheet, which is a back surface of the first sheet. The printing apparatus includes a sheet feeding unit 1, a decurl unit 2, a skew correction unit 3, a printing unit 4, an inspection unit 5, a cutter unit 6, an information recording unit 7, a drying unit 8, an reverse unit 9, an ejection conveying unit 10, a sorter unit 11, an ejection unit 12, a humidifying unit 20, and a control unit 13. A sheet is conveyed by a conveying mechanism including rollers or a belt disposed along a sheet conveying path shown as a solid line in FIG. 1 and is processed by the units. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The sheet feeding unit 1 holds a rolled continuous sheet and feeds the continuous sheet. The sheet feeding unit 1 can contain two rolls R1 and R2. The sheet feeding unit 1 selects one of the rolls R1 and R2 and draws a sheet from the selected roll and feeds the sheet. Note that the number of rolls contained in the sheet feeding unit 1 is not limited to two. For example, the number of contained rolls may be one or three or more. Alternatively, a continuous sheet that is not rolled can be used. For example, a continuous sheet having perforations at predetermined intervals may be folded at the perforations and stacked in the sheet feeding unit 1.

The decurl unit 2 reduces the curl of the sheet fed from the sheet feeding unit 1. The decurl unit 2 allows the sheet to pass therethrough using two pinch rollers corresponding to one driving rollers in order to curve the sheet so that an inverse curl is supplied to the sheet. In this way, a decurling force is applied to the sheet and, therefore, the curl is reduced.

The skew correction unit 3 corrects the skew of the sheet that has passed through the decurl unit 2 (the inclination of the sheet with respect to the designed feed direction). By urging the end of the sheet on the reference side against a guide member, a skew can be corrected.

The printing unit 4 performs a printing operation on the sheet and forms an image on the sheet using a print head assembly 14 disposed above the conveyed sheet. That is, the printing unit 4 serves as a processing unit that performs a predetermined processing on the sheet. The printing unit 4 includes a plurality of conveying rollers that convey the sheet. The print head assembly 14 includes a line print head having an inkjet nozzle row that covers the maximum width of the sheet to be used. In the print head assembly 14, a plurality of print heads are arranged in parallel along the conveying direction. In this example, the print head assembly 14 includes seven print heads corresponding to the following seven colors: cyan (C), magenta (M), yellow (Y), light cyan (LC), light magenta (LM), grey (G), and black (K). However, it should be noted that the number of colors and the number of print heads are not limited to seven. Examples of the inkjet method include a method using a heater element, a method using a piezoelectric element, a method using an electrostatic element, and a method using a microelectromechanical system (MEMS) element. The ink of each color is supplied from an ink tank to the print head assembly 14 via an ink tube.

The inspection unit 5 optically scans, using a scanner, an inspection pattern or an image printed on a sheet by the printing unit 4 and inspects the state of a nozzle of the print head, the conveying state of a sheet, and the position of an image. In this way, the inspection unit 5 determines whether an image has been correctly printed. The scanner includes a charge-coupled device (CCD) image sensor or a complementary metal-oxide semiconductor (CMOS) image sensor.

The cutter unit 6 includes a mechanical cutter that cuts the printed sheet into predetermined lengths. The cutter unit 6 further includes a plurality of conveying rollers that convey the sheet to the next processing stage.

The information recording unit 7 records print information (unique information), such as the serial number of the print-out and the date and time, in the non-print area of the cut sheet. The information is recorded by printing characters and code on the sheet using, for example, an inkjet method or a thermal transfer method. A sensor 23 that detects the leading edge of the cut sheet is disposed upstream of the information recording unit 7 and downstream of the cutter unit 6. That is, the sensor 23 detects the edge of the sheet at a recording position located between the cutter unit 6 and the information recording unit 7. The information recording unit 7 controls a point in time at which the information is recorded on the basis of a point in time at which the sensor 23 detects the edge of the sheet.

Figure 2:
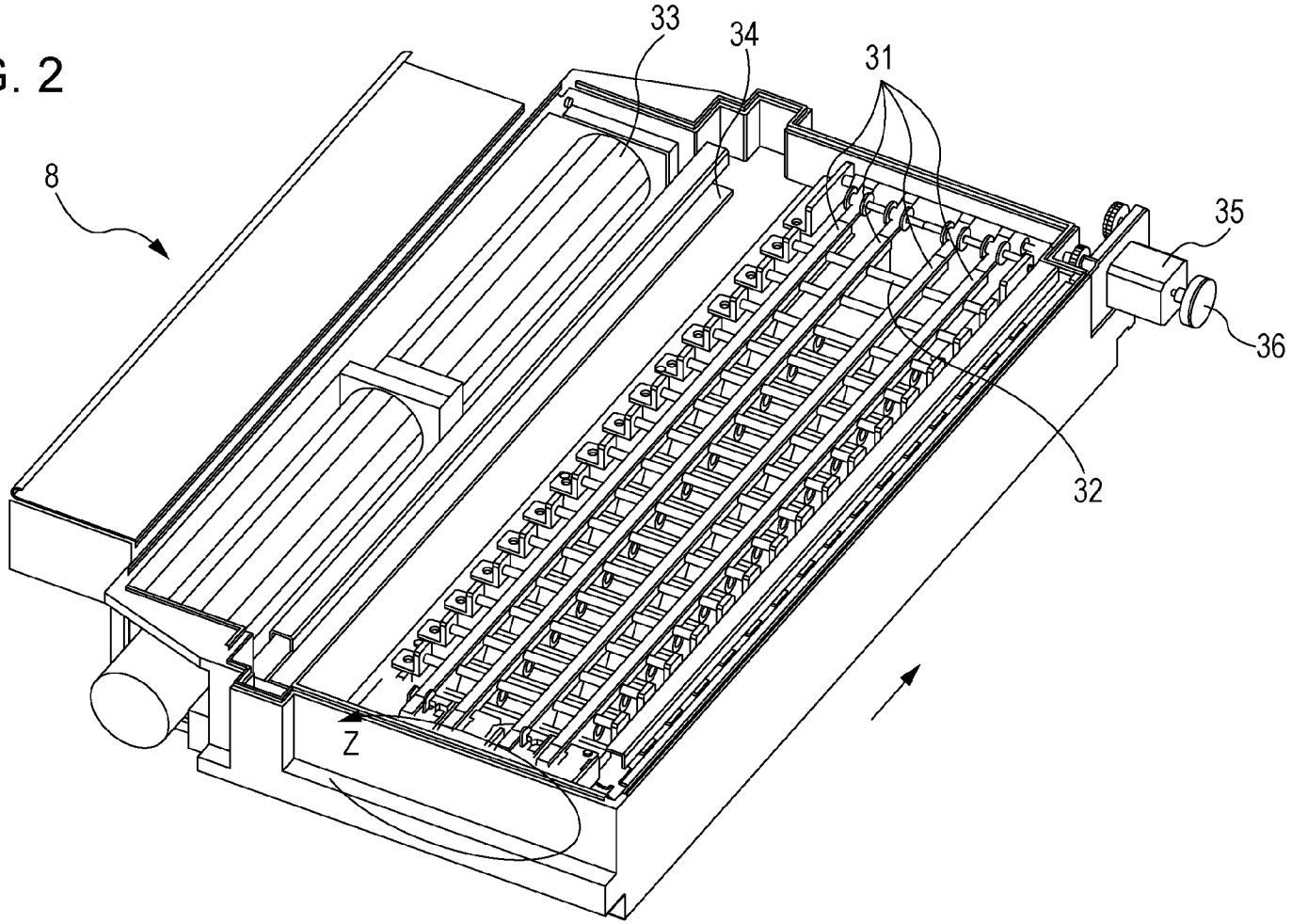
FIG. 2 is a perspective view of an exemplary internal configuration of a drying unit.

The drying unit 8 heats the sheet printed by the printing unit 4 to dry the applied ink in a short time. The drying unit 8 includes conveyer belts and conveying rollers for advancing the sheet to the next processing stage. FIG. 2 illustrates an exemplary internal configuration of the drying unit 8. The sheet is pinched by a plurality of conveyer belts 31 and rollers 32 and is moved. A rotational driving force generated by a motor 35 is transferred to the plurality of conveyer belts 31. The rotation state of the motor 35 is detected by a rotary encoder 36. Thus, the rotation state of the rotary encoder 36 provides feedback information such that the motor 35 is feedback-controlled. A printed surface having the ink thereon that should be dried faces downward (towards the floor). Gas (the air) heated by a heater 34 is circulated by a fan 33 in the Z direction in FIG. 2. Thus, the heated air is applied to the sheet that passes through the drying unit 8 in at least the upward direction. In this way, the surface having the ink applied thereon is dried. If the ink is rapidly dried, the sheet is easily warped. However, during a drying operation, the sheet is pinched by the plurality of conveyer belts 31 and the plurality of conveyer belts 31 and rollers 32. Accordingly, the warping of the sheet is prevented. Note that instead of applying heated air, the drying unit 8 can dry the ink by radiating electromagnetic waves (e.g., ultraviolet rays or infrared rays) to the surface of the sheet.

As used herein, the above-described sheet conveying path from the sheet feeding unit 1 to the drying unit 8 is referred to as a "first path". The first path has a shape to perform a U-turn between the printing unit 4 and the drying unit 8. The cutter unit 6 is located in the U-turn.

The reverse unit 9 temporarily winds the printed continuous sheet and turns over the sheet when duplex printing is performed. In order to feed the sheet that has passed through the drying unit 8 to the printing unit 4 again, the reverse unit 9 is disposed in a path from the drying unit 8 to the printing unit 4 via the decurl unit 2 (a loop path, hereinafter referred to as a "second path"). The reverse unit 9 includes a winding rotary member (a drum) that rotates to reel in the sheet. The printed continuous sheet before being cut is temporarily wound around the winding rotary member. After the continuous sheet is wound, the winding rotary member rotates in the opposite direction and, therefore, the continuous sheet is fed in a direction opposite that when the continuous sheet is wound. The continuous sheet is fed to the decurl unit 2 and is delivered to the printing unit 4. Since the sheet is turned over, the printing unit 4 can perform a printing operation on the back surface of the sheet. Such duplex printing is described in more detail below.

The ejection conveying unit 10 conveys the sheet cut by the cutter unit 6 and dried by the drying unit 8 and delivers the sheet to the sorter unit 11. The ejection conveying unit 10 is disposed in a path that is different from the second path having the reverse unit 9 thereon (hereinafter, referred to as a "third path"). In order to selectively deliver the sheet that has been conveyed along the first path to the second path or the third path, a path switching mechanism including a movable flapper is disposed at a branch position in the path.

The sorter unit 11 and the ejection unit 12 are disposed at the end of the third path to be adjacent to the sheet feeding unit 1. The sorter unit 11 sorts the printed sheets into groups as needed. The sorted sheets are ejected to the ejection unit 12 including a plurality of trays. In this way, the third path is designed to allow a sheet to pass beneath the sheet feeding unit 1 and allow the sheet to be ejected to the opposite side of the sheet feeding unit 1 from the printing unit 4 and the drying unit 8.

As described above, the units from the sheet feeding unit 1 to the drying unit 8 are sequentially arranged along the first path. Downstream of the drying unit 8, the first path branches into the second path and the third path. The reverse unit 9 is disposed in the middle of the second path. Downstream of the reverse unit 9, the second path merges with the first path. The ejection unit 12 is disposed at the end of the third path.

The humidifying unit 20 generates humidifying gas (the humidifying air) and supplies the generated humidifying gas to a space between the print head assembly 14 of the printing unit 4 and the sheet. Thus, drying of the ink in nozzles of the print head assembly 14 can be prevented. Examples of the humidifying method employed by the humidifying unit 20 include a vaporization method, a water spray method, and a steam air method. In addition to a rotary method according to the present embodiment, the vaporization method has a water permeable membrane type, a water droplet infiltration type, and a capillary type. The water spray method has an ultrasonic type, a centrifugal impeller type, a high-pressure spray type, and a two-liquid spray type. The steam air method has a steam piping type, an electrical heating type, and an electrode type. The humidifying unit 20 is connected to the printing unit 4 using a first duct 21. Furthermore, the humidifying unit 20 is connected to the drying unit 8 using a second duct 22. In the drying unit 8, humid and high-temperature gas is generated when the sheet is dried. The gas is led to the humidifying unit 20 via the second duct 22 and is used as auxiliary energy for generating humidifying gas in the humidifying unit 20. The humidifying gas generated in the humidifying unit 20 is led to the printing unit 4 via the first duct 21.

The control unit 13 performs overall control of the printing apparatus. The control unit 13 includes a controller having a central processing unit (CPU), a storage unit, and a variety of control sub-units, an external interface, and an operation unit 15 used by the user when the user inputs data and receives output data. The operation performed by the printing apparatus is controlled using instructions received from the controller or a host apparatus 16, such as a host computer, connected to the controller via the external interface.

Figure 3:
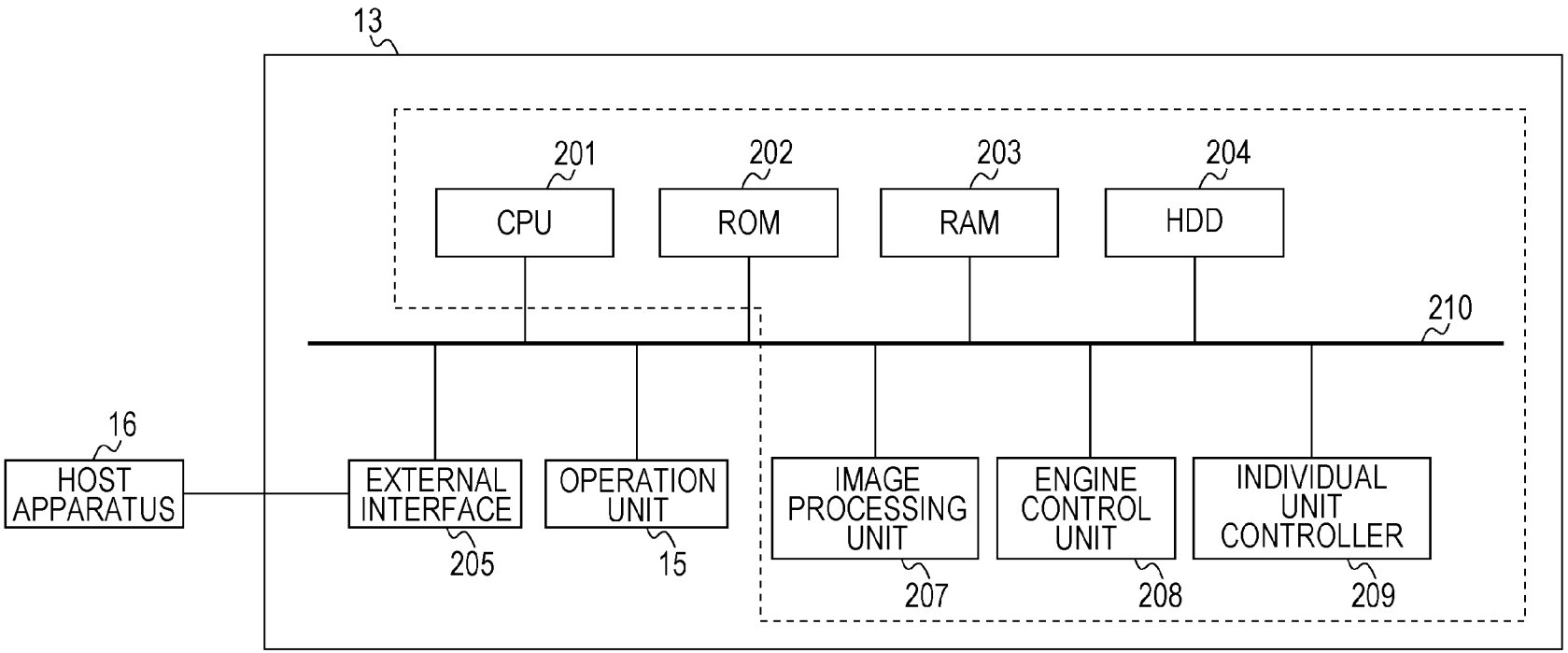
FIG. 3 is a block diagram schematically illustrating a control unit.

FIG. 3 is a block diagram schematically illustrating the control unit 13. The controller (a block enclosed by a dashed line) disposed in the control unit 13 includes a CPU 201, a read only memory (ROM) 202, a random access memory (RAM) 203, a hard disk drive (HDD) 204, an image processing unit 207, an engine control unit 208, and an individual unit controller 209. The CPU 201 performs overall control of the printing apparatus. The ROM 202 stores programs executed by the CPU 201 and fixed data necessary for the printing apparatus to perform a variety of operations. The RAM 203 is used as a work area of the CPU 201 and a temporary storage area for a variety of received data items. In addition, the RAM 203 stores a variety of setting data items. The HDD 204 can store and deliver programs executed by the CPU 201, print data, and setting information necessary for the operation performed by the printing apparatus. The operation unit 15 serves as an input/output interface with the user. The operation unit 15 includes hard keys, an input unit of a touch-sensitive panel, and a display and a sound generator for outputting information.

Each of the units that are required to perform a high-speed operation includes a dedicated processing unit. The image processing unit 207 performs image processing on print data manipulated by the printing apparatus. The image processing unit 207 converts the color space of the input image data (e.g., YCbCr) into a standard RGB color space (e.g., sRGB). In addition, the image processing unit 207 performs a variety of image processing, such as resolution conversion, image analysis, and image correction, on the image data as needed. Print data obtained through such image processing is stored in the RAM 203 or the HDD 204. In response to a control command received from the CPU 201, the engine control unit 208 controls driving of the print head assembly 14 of the printing unit 4 using the print data. The engine control unit 208 further controls a conveying mechanism of each of the units in the printing apparatus. The individual unit controller 209 is a sub-controller that individually controls the sheet feeding unit 1, the decurl unit 2, the skew correction unit 3, the inspection unit 5, the cutter unit 6, the information recording unit 7, the drying unit 8, the reverse unit 9, the ejection conveying unit 10, the sorter unit 11, the ejection unit 12, and the humidifying unit 20. In response to an instruction received from the CPU 201, the individual unit controller 209 controls the operation of each of the units. An external interface 205 is an interface (I/F) used for connecting the controller to the host apparatus 16. The external interface 205 is a local I/F or a network I/F. The above-described components of the printing apparatus are connected to one another via a system bus 210.

The host apparatus 16 serves as a supply source of image data to be printed by the printing apparatus. The host apparatus 16 may be a general-purpose computer or a dedicated computer. Alternatively, the host apparatus 16 may be a dedicated imaging device, such as an image capturing device including an image reader unit, a digital camera, or a photo storage device. When the host apparatus 16 is a computer, a storage unit of the computer stores an operating system (OS), application software that generates image data, and a printer driver for the printing apparatus installed therein. However, it should be noted that all of the above-described processes are not necessarily realized by software. Some or all of the processes may be realized by hardware.

The basic operation performed during a printing operation is described next. The operation in a simplex print mode differs from that in a duplex print mode. Accordingly, both the operations are described below.

Figure 4:
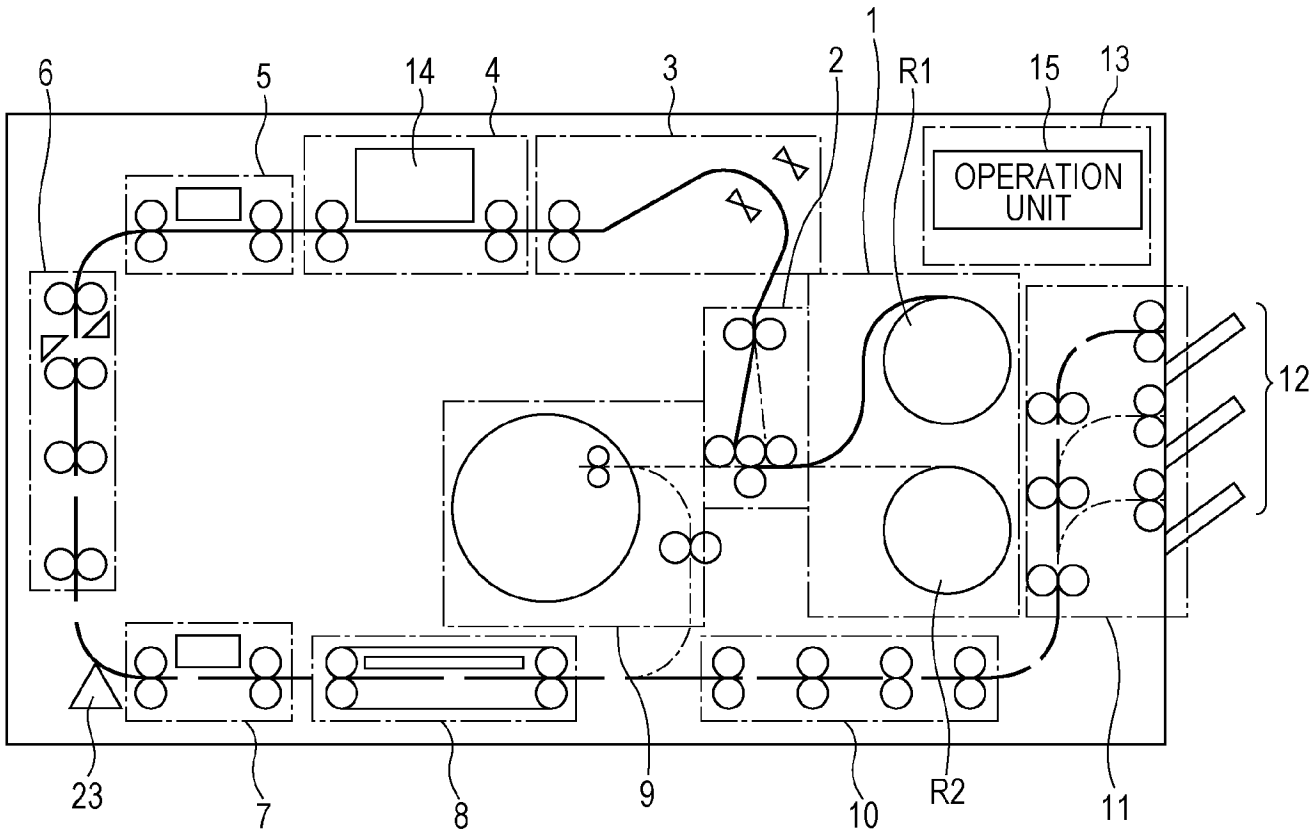
FIG. 4 illustrates the operation performed in a simplex print mode.

FIG. 4 illustrates the operation performed in a simplex print mode. A sheet is fed from the sheet feeding unit 1 and is subjected to the processing performed by the decurl unit 2 and the skew correction unit 3. Thereafter, printing is performed on the front surface (the first surface) of the sheet in the printing unit 4. Printing of an image having a predetermined unit length in the conveying direction (a unit image) is sequentially performed on the continuous sheet. Thus, a plurality of images are formed to be sequentially arranged on the continuous sheet. The printed sheet passes through the inspection unit 5 and is cut into the unit images by the cutter unit 6. The print information is printed on the back surfaces of the cut sheets in the information recording unit 7 as needed. Subsequently, the cut sheets are conveyed to the drying unit 8 one by one, where the sheets are dried. Thereafter, the sheets pass through the ejection conveying unit 10 and are sequentially ejected and stacked on the ejection unit 12 of the sorter unit 11. In contrast, the sheet remaining on the side of the printing unit 4 after the last unit image is cut out is delivered back to the sheet feeding unit 1. The sheet is wound around the roll R1 or R2.

In this way, in a simplex print mode, the sheet passes through the first path and the third path. The sheet does not pass through the second path. In summary, in a simplex print mode, the following six sequences (1) to (6) are applied under the control of the control unit 13:

(1) feeding a sheet from the sheet feeding unit 1 and feeding the sheet to the printing unit 4, (2) repeating printing of a unit image on the first surface of the fed sheet in the printing unit 4, (3) repeating a cutting operation of the sheet for each of the unit images printed on the first surface of the sheet, (4) allowing the cut sheets each having a unit image thereon to pass through the drying unit 8 one by one and facilitating drying of the ink, (5) ejecting the sheets that have passed through the drying unit 8 one by one onto the ejection unit 12 via the third path, and (6) cutting the sheet for the last unit image and delivering back the sheet remaining on the side of the printing unit 4 to the sheet feeding unit 1.

Figure 5:
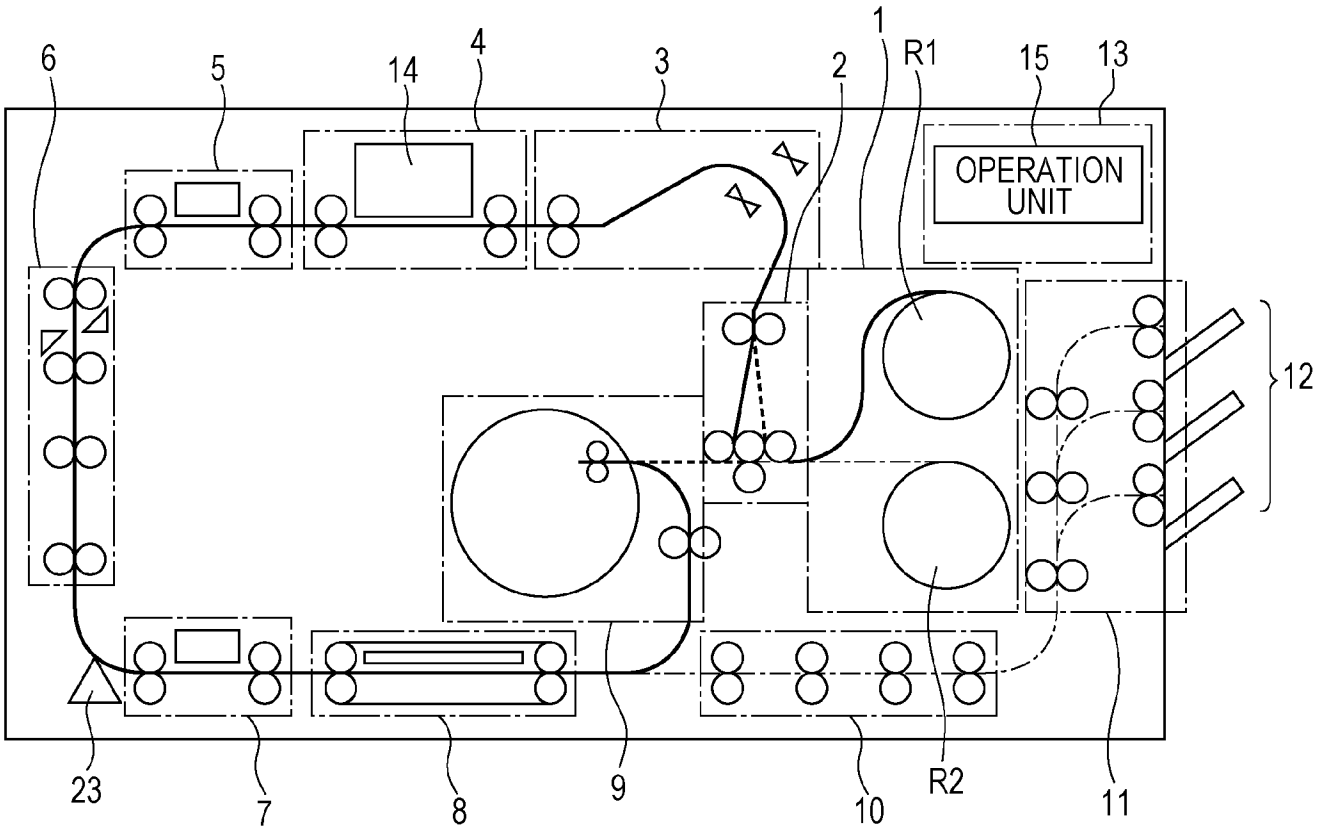
FIG. 5 illustrates the operation performed in a duplex print mode.

FIG. 5 illustrates the operation performed in a duplex print mode. In a duplex print mode, after first print sequences on the front surface (the first surface) are completed, second print sequences on the back surface (the second surface) are performed. In the first print sequences, the operations performed by the sheet feeding unit 1 to the inspection unit 5 are the same as those in the simplex print mode. However, the cutting operation is not performed by the cutter unit 6. The continuous sheet is conveyed to the drying unit 8. The drying unit 8 dries the ink on the front surface of the continuous sheet. Thereafter, the sheet is led to the path on the side of the reverse unit 9 (the second path), not the path on the side of the ejection conveying unit 10 (the third path). In the second path, the sheet is reeled in around the winding rotary member of the reverse unit 9 that rotates in the forward direction (the counterclockwise direction in FIG. 5). After the printing on planned area of the front surface is completed in the printing unit 4, the trailing edge of the printed area of the continuous sheet is cut by the cutter unit 6. The entirety of the portion of the continuous sheet downstream of the cut position (on the side of the printed area) in the conveying direction is rewound by the reverse unit 9 via the drying unit 8. In contrast, at the same time as the rewinding operation, the portion of the continuous sheet remaining upstream of the cut position (on the side of the printing unit 4) in the conveying direction is fed back to the sheet feeding unit 1 and reeled in around the roll R1 or R2 so that the edge of the portion (the cut edge) does not remain in the decurl unit 2. Through such rewinding operation, the sheet does not collide with the sheet that is subsequently fed for the back surface printing described below.

After the above-described front surface printing sequences are completed, the processing is switched to the back surface printing sequences. The winding rotary member of the reverse unit 9 rotates in a direction (a clockwise direction in FIG. 5) that is the reverse of the direction when the sheet was reeled in. The edge of the wound sheet (the trailing edge of the sheet when reeled is changed to the leading edge when fed) is conveyed into the decurl unit 2 along the path shown as a dashed line in FIG. 5. A curl of the sheet given by the winding rotary member is decurled in the decurl unit 2. That is, the decurl unit 2 is disposed between the sheet feeding unit 1 and the printing unit 4 in the first path and is disposed between the reverse unit 9 and the printing unit 4 in the second path. In either path, the decurl unit 2 serves as a shared unit for decurling. The turned-over sheet is advanced to the printing unit 4 via the skew correction unit 3, and printing on the back surface of the sheet is performed. The printed sheet passes through the inspection unit 5 and is cut into sheets each having a preset unit length by the cutter unit 6. Since either side of each of the cut sheets is printed, recording is not performed by the information recording unit 7. The cut sheets are conveyed to the drying unit 8 one by one. Thereafter, the cut sheets are sequentially ejected to the ejection unit 12 of the sorter unit 11 via the ejection conveying unit 10.

In this way, in the duplex print mode, the sheet passes through the first path, the second path, the first path, and the third path and is processed. In summary, in the duplex print mode, the following sequences (1) to (11) are applied under the control of the control unit 13:

(1) feeding a sheet from the sheet feeding unit 1 and feeding the sheet to the printing unit 4, (2) repeating printing of a unit image on the first surface of the fed sheet using the printing unit 4, (3) allowing the sheet having the printed first surface to pass through the drying unit 8 to facilitate drying, (4) leading the sheet that has passed through the drying unit 8 to the second path and winding the sheet around the winding rotary member of the reverse unit 9, (5) cutting the sheet at the tail end of the last printed unit image using the cutter unit 6 after repeated printing on the first surface is completed, (6) winding the cut sheet around the winding rotary member until the trailing edge of the cut sheet passes through the drying unit 8 and reaches the winding rotary member and, concurrently, conveying the sheet remaining on the side of the printing unit 4 after cutting back to the sheet feeding unit 1, (7) rotating the winding rotary member in the opposite direction after the winding is completed and feeding the sheet to the printing unit 4 via the second path again, (8) repeatedly printing a unit image on the second surface of the sheet fed from the second path using the printing unit 4, (9) cutting the sheet for each of the unit images printed on the second surface using the cutter unit 6,

(10) allowing the cut sheets each having a unit image thereon to pass through the drying unit 8 one by one in order to facilitate drying the ink, and

(11) ejecting each of the cut sheets that has passed through the drying unit 8 onto the ejection unit 12 via the third path.

Figure 6A:
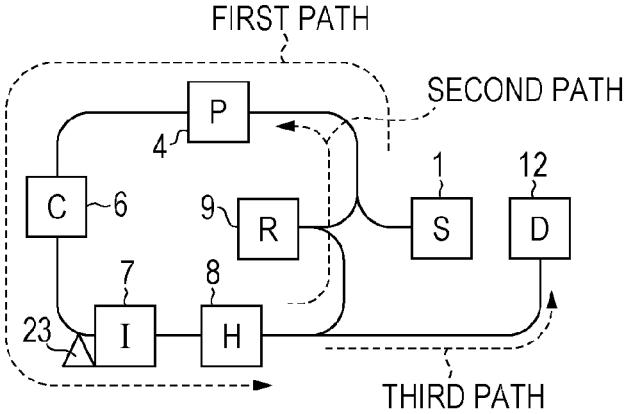
FIGS. 6A to 6D are schematic illustrations of the layouts of units of the printing apparatus along a sheet conveying path.
Figure 6B:
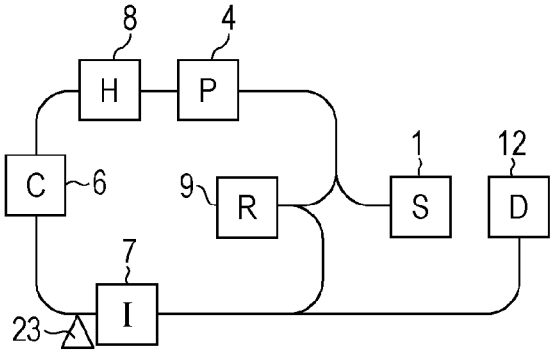
Figure 6C:
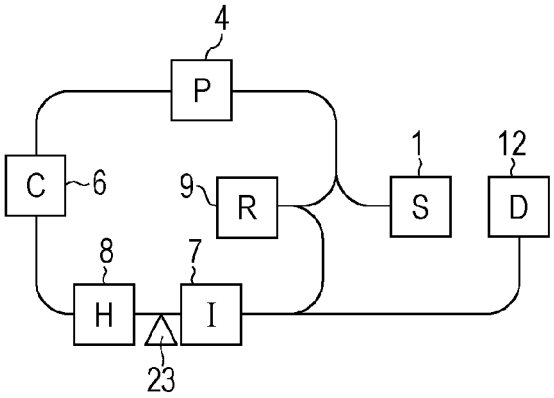
Figure 6D:
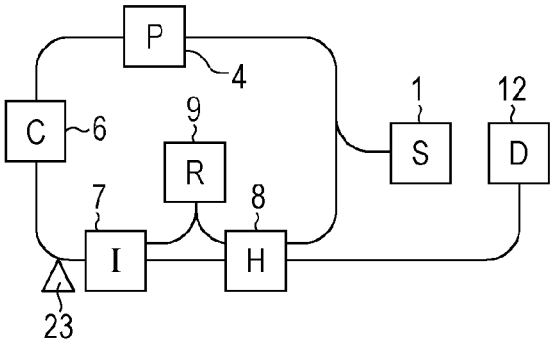

The rationality of the above-described layout of the units of the printing apparatus in the vicinity of the drying unit 8 is described in more detail below. FIGS. 6A to 6D are schematic illustrations of the positional relationship among the units disposed along the sheet conveying path. FIG. 6A is a schematic illustration of the layout of the units of the printing apparatus according to the present embodiment. In FIG. 6A, the first path extends from the sheet feeding unit 1 (S) to the drying unit 8 (H). The second path extends from the drying unit 8 to the printing unit 4 (P). The third path extends from the drying unit 8 to the ejection unit 12 (D). FIGS. 6B to 6D are schematic illustrations of a virtual layout used for comparison with the present embodiment.

[1] In the layout shown in FIG. 6A according to the present embodiment, the drying unit 8 (H) is disposed downstream of the cutter unit 6 (C). As described above, in a duplex print mode, after the front surface is printed and the sheet is cut into cut sheets, the sheet upstream of the cut position is rewound around the sheet feeding unit 1. If, as indicated by the layout shown in FIG. 6B, the drying unit 8 is disposed upstream of the cutter unit 6, a portion of the sheet that has already passed through the drying unit 8 passes through the drying unit 8 again when the sheet after being cut is rewound around the sheet feeding unit 1. Accordingly, the leading edge portion of the sheet having a length equal to the path length between the drying unit 8 and the cutter unit 6 is partially and excessively dried. Thus, non-uniform moistening occurs. However, according to the layout shown in FIG. 6A, since the sheet is cut at a position upstream of the drying unit 8, non-uniform moistening of the sheet does not occur even when the sheet is rewound.

[2] In the layout shown in FIG. 6A according to the present embodiment, the information recording unit 7 (I) is disposed downstream of the cutter unit 6 (C) and upstream of the drying unit 8 (H). Since the sheet passes through the drying unit 8 immediately after being printed by the information recording unit 7, the ink applied by the information recording unit 7 rapidly dries. If, as indicated by the layouts shown in FIGS. 6B and 6C, the information recording unit 7 is disposed downstream of the drying unit 8, the sheet is ejected onto the ejection unit 12 before the ink applied by the information recording unit 7 has dried. Thus, the ink may adhere to another stacked sheet.

[3] In the layout shown in FIG. 6A according to the present embodiment, the reverse unit 9 (R) is disposed downstream of the drying unit 8 (H). Accordingly, in the duplex print mode, the ink applied to the front surface of the sheet is reliably dried in the drying unit 8 and, subsequently, the sheet is rewound by the reverse unit 9. If, as indicated by the layout shown in FIG. 6D, the reverse unit 9 is disposed upstream of the drying unit 8, the sheet is rewound before the ink applied by the printing unit 4 has dried. Thus, the ink may adhere to the topped sheet.

[4] In the layout shown in FIG. 6A according to the present embodiment, the sheet passes through the shared drying unit 8 twice in the duplex print mode. The surface to which ink is applied in the first printing faces the floor when the sheet passes through the drying unit 8 twice. Thus, the ink is exposed to heated air generated by a heater and rising from below. That is, the drying unit 8 can be configured to heat mainly one side of the sheet, not both sides of the sheet. Therefore, the size of the drying unit 8 and the power consumption of the drying unit 8 can be reduced. As a result, the size of the printing apparatus and the power consumption of the printing apparatus can be reduced.

[5] In the layout shown in FIG. 6A according to the present embodiment, the printing unit 4 (P) and the drying unit 8 (H) are arranged in the vertical direction on the same side of the sheet feeding unit 1 (S). The sheet is conveyed along a path having a substantially U-turn shape between the printing unit 4 and the drying unit 8. The direction in which the sheet moves in the printing unit 4 is opposite that in the drying unit 8. The printed sheet that has passed through the drying unit 8 passes through a path beneath the sheet feeding unit 1 and is ejected onto the ejection unit 12. Such a layout allows the sheet feeding unit 1 and the ejection unit 12 to be disposed in the vicinity of the end of the printing apparatus on the same side. Accordingly, the user can access the sheet feeding unit 1 and the ejection unit 12 without moving a long distance. Thus, the user can mount a new roll sheet and collect the printed sheets in an efficient manner.

[6] The printing unit 4 and the drying unit 8 are arranged in the vertical direction. The path between the printing unit 4 and the drying unit 8 has a substantially U-turn shape. In addition, an ejection path extending from the drying unit 8 is located beneath the sheet feeding unit 1. Since the units having a large size are arranged in the vertical direction, the footprint of the printing apparatus can be reduced.

[7] In the layout shown in FIG. 6A according to the present embodiment, the printing unit 4 is disposed in the upper section of the housing of the printing apparatus. Accordingly, the user can easily maintain (e.g., exchange) the print head by inserting their hand from above.

[8] According to the present embodiment, the gas having high temperature and humidity is not directly discharged from the drying unit 8 to the outside of the printing apparatus. The gas or heat is used for generating humidifying gas in the humidifying unit 20. Accordingly, the total energy efficiency of the printing apparatus can be increased.

[9] According to the present embodiment, the sheet fed from the sheet feeding unit 1 to the printing unit 4 and the sheet fed from the reverse unit 9 to the printing unit 4 are decurled towards the appropriate direction by the shared decurl unit 2. That is, in the duplex print mode, two decurl operations can be performed before the front surface of the sheet is printed and before the back surface of the sheet is printed. In addition, since the decurl unit 2 has a simplified and compact configuration, the overall size of the printing apparatus can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042349 filed Feb. 26, 2010, which is hereby incorporated by reference herein in its entirety.

What is claimed is:

1. An apparatus for performing duplex printing comprising:

a sheet feeding unit configured to feed a sheet along a path, wherein the sheet is continuous;

a printing unit, disposed in the path, configured to perform inkjet printing on the sheet;

a cutter unit, disposed downstream of the printing unit in the path, configured to cut the sheet;

a drying unit, disposed downstream of the cutter unit in the path, configured to dry the sheet printed in the printing unit; and a reverse unit configured to reverse the sheet that has passed through the drying unit, wherein, in the duplex printing, the printing unit prints a plurality of images on a first surface of the sheet fed from the sheet feeding unit, the sheet printed on the first surface passes through the drying unit and is led to the reverse unit, the reverse unit feeds the reversed sheet to the printing unit, the printing unit prints a plurality of images on a second surface that is a back of the first surface of the sheet fed from the reverse unit, the cutter unit cuts the sheet printed on the second surface into a plurality of cut sheets, and the cut sheets pass through the drying unit and are ejected, wherein the reverse unit includes a winding rotary member, and in the duplex printing, the sheet having a plurality of images printed on the first surface is reeled in the winding rotary member, subsequently, the winding rotary member rotates in an opposite direction, and the reeled sheet is fed to the printing unit again.

2. The apparatus according to claim 1, wherein the cutter unit cuts the sheet after printing of the plurality of images on the first surface is completed, and the sheet remaining on a side of the printing unit is conveyed back to the sheet feeding unit before the reverse unit feeds the sheet to the printing unit again.

3. The apparatus according to claim 2, wherein the drying unit applies heat or electromagnetic waves to the sheet.

4. The apparatus according to claim 3, wherein the sheet feeding unit, the printing unit, the cutter unit, and the drying unit are arranged along a first path, the first path branches into a second path and a third path, the reverse unit is disposed in the second path and the second path merges with the first path at an upstream side of the printing unit, and an ejection unit to which the cut sheets are ejected is disposed at the third path.

5. The apparatus according to claim 1, wherein in the duplex printing, the following sequences are applied:

(1) feeding the continuous sheet from the sheet feeding unit to the printing unit, (2) printing the plurality of images sequentially on the first surface of the sheet fed from the sheet feeding unit using the printing unit, (3) allowing the sheet printed on the first surface to pass through the drying unit, (4) cutting the sheet, into a cut sheet, at a tail end of a last printed image using the cutter unit after printing on the first surface is completed, (5) winding the cut sheet around the winding rotary member until a trailing edge of the cut sheet passes through the drying unit and reaches the winding rotary member and, concurrently, conveying the sheet remaining on the side of the printing unit back to the sheet feeding unit, (6) rotating the winding rotary member in the opposite direction after the winding is completed and feeding the reversed sheet to the printing unit again, (7) printing the plurality of images sequentially on the second surface of the sheet fed from the winding rotary member using the printing unit, (8) cutting the sheet printed on the second surface using the cutter unit into the plurality of cut sheets each having the image printed thereon, and (9) allowing the cut sheets to pass through the drying unit one by one, and ejecting each of the cut sheets.

6. The apparatus according to claim 5, wherein at least one of the duplex printing and a simplex printing is selectable, and wherein in the simplex printing, the following sequences are applied:

(1) feeding the continuous sheet from the sheet feeding unit to the printing unit, (2) printing the plurality of images sequentially on the first surface of the sheet fed from the sheet feeding unit using the printing unit, (3) cutting the sheet printed on the first surface using the cutter unit into a plurality of cut sheets each having the image printed thereon, and (4) allowing the cut sheets to pass through the drying unit one by one, and ejecting each of the cut sheets.

7. The apparatus according to claim 1, further comprising:

an information recording unit configured to record unique information on each of cut sheets cut by the cutter unit;

wherein the information recording unit records the information at a recording position between the cutter unit and the drying unit.

8. The apparatus according to claim 7, further comprising:

a sensor configured to detect an end of each of the cut sheets between the cutter unit and the recording position, wherein a recording timing of the information recording unit is controlled on a basis of detection of the sensor.

9. The apparatus according to claim 1, further comprising:

a humidifying unit configured to generate humidifying gas;

wherein gas or heat discharged from the drying unit is used to generate the humidifying gas by the humidifying unit.

10. The apparatus according to claim 9, further comprising:

a first duct configured to introduce the humidifying gas from the humidifying unit to the printing unit; and a second duct configured to introduce gas discharged from the drying unit to the humidifying unit;

wherein the gas discharged from the drying unit is used to generate the humidifying gas by the humidifying unit.

11. The apparatus according to claim 1, further comprising:

a decurl unit configured to reduce a curl of the sheet fed from the sheet feeding unit to the printing unit, and a curl of the sheet fed from the reverse unit to the printing unit.

12. The apparatus according to claim 11, further comprising:

a skew correction unit configured to correct a skew of the sheet between the decurl unit and the printing unit.

13. An apparatus for performing duplex printing comprising:

a sheet feeding unit configured to feed a sheet along a path, wherein the sheet is continuous;

a printing unit, disposed in the path, configured to perform inkjet printing on the sheet;

a cutter unit, disposed downstream of the printing unit in the path, configured to cut the sheet:

a drying unit, disposed downstream of the cutter unit in the path, configured to dry the sheet printed in the printing unit; and a reverse unit configured to reverse the sheet that has passed through the drying unit, wherein, in the duplex printing, the printing unit prints a plurality of images on a first surface of the sheet fed from the sheet feeding unit, the sheet printed on the first surface passes through the drying unit and is led to the reverse unit, the reverse unit feeds the reversed sheet to the printing unit, the printing unit prints a plurality of images on a second surface that is a back of the first surface of the sheet fed from the reverse unit, the cutter unit cuts the sheet printed on the second surface into a plurality of cut sheets, and the cut sheets pass through the drying unit and are ejected, wherein the printing unit includes an inkjet print head that applies, from above, ink to the sheet passing through the printing unit, and wherein the printing unit is located above the drying unit, and wherein a direction in which the sheet moves in the printing unit is opposite to a direction in which the sheet moves in the drying unit.

14. The apparatus according to claim 13, wherein a path between the printing unit and the drying unit has a U-turn shape, and wherein the cutter unit is disposed in the path of the U-turn shape.

15. The apparatus according to claim 13, wherein part of a path in which the cut sheets are ejected extends beneath the sheet feeding unit, and the cut sheets are ejected to an ejection unit disposed adjacent to the sheet feeding unit.

16. The apparatus according to claim 13, wherein the drying unit includes a mechanism that applies heated air to the sheet passing through the drying unit at least from below so that the surface of the sheet having ink applied thereon is dried.

17. A method, comprising:

(1) feeding a sheet from a sheet feeding unit to a printing unit, wherein the sheet is continuous;

(2) printing a plurality of images sequentially on a first surface of the sheet fed from the sheet feeding unit using a printing unit;

(3) allowing the sheet printed on the first surface to pass through a heating unit;

(4) cutting the sheet, into a cut sheet, at a tail end of a last printed image using a cutter unit after printing on the first surface is completed;

(5) winding the cut sheet around the winding rotary member until a trailing edge of the cut sheet passes through the drying unit and reaches the winding rotary member;

(6) rotating the winding rotary member in an opposite direction after the winding is completed and feeding the sheet to the printing unit again;

(8) printing a plurality of images on a second surface that is a back of the first surface of the sheet fed from the winding rotary member using the printing unit;

(9) cutting the sheet printed on the second surface into the plurality of cut sheets each having the image printed thereon using the cutter unit; and

(10) allowing the cut sheets to pass through the heating unit one by one.

18. The method according to claim 17, wherein the printing unit includes an inkjet print head, and the heating unit applies heat or electromagnetic waves to the sheet.

19. The method according to claim 18, wherein the inkjet print head applies, from above, ink to the sheet passing through the printing unit, and wherein the printing unit is located above the heating unit, and wherein a direction in which the sheet moves in the printing unit is opposite to a direction in which the sheet moves in the heating unit.

20. A method, comprising:

(1) feeding a sheet from a sheet feeding unit to a processing unit, wherein the sheet is continuous;

(2) repeatedly performing a predetermined process that requires a heating process on a first surface of the sheet fed from the sheet feeding unit;

(3) allowing the sheet having the processed first surface to pass through a heating unit;

(4) cutting the sheet, into a cut sheet, after a last process of the repeated processes on the first surface is completed;

(5) winding the cut sheet around the winding rotary member until a trailing edge of the cut sheet passes through the heating unit and reaches the winding rotary member;

(6) rotating the winding rotary member in the opposite direction after the winding is completed and feeding the sheet to the processing unit again;

(8) repeatedly performing the predetermined process on a second surface which is the back of the first surface of the sheet fed from the winding rotary member using the processing unit;

(9) cutting the sheet having the processed second surface into a plurality of cut sheets using the cutter unit; and

(10) allowing the cut sheets to pass through the heating unit.

21. A method according to claim 20, wherein the heating unit applies heat or electromagnetic waves to the sheet.

* * * * *